US010082255B2

(12) United States Patent
Sussman et al.

(10) Patent No.: US 10,082,255 B2
(45) Date of Patent: Sep. 25, 2018

(54) HIGH-EFFICIENCY LED MODULE

(71) Applicants: Peter Sussman, St. Louis Park, MN (US); Shenzhen Lingbenyang Technical Co., Ltd., Shenzhen, GuangDong (CN)

(72) Inventors: Peter Sussman, St. Louis Park, MN (US); Wen XiaoGui, Shenzhen (CN); Zheng DengGang, Shenzhen (CN)

(73) Assignees: Peter Sussman, St. Louis Park, MN (US); Shenzhen Lingbenyang Technical Co., Ltd., Shenzhen (CN)

( * ) Notice: Subject to any disclaimer, the term of this patent is extended or adjusted under 35 U.S.C. 154(b) by 41 days.

(21) Appl. No.: 14/990,186

(22) Filed: Jan. 7, 2016

(65) Prior Publication Data

US 2017/0138551 A1 May 18, 2017

(30) Foreign Application Priority Data

Nov. 17, 2015 (CN) ..... 2015 2 0921498 U

(51) Int. Cl.

| | |
|---|---|
| ***F21V 29/00*** | (2015.01) |
| ***F21K 9/69*** | (2016.01) |
| ***F21V 29/70*** | (2015.01) |
| ***F21K 9/90*** | (2016.01) |
| ***F21V 5/04*** | (2006.01) |
| ***F21V 17/16*** | (2006.01) |

(Continued)

(52) U.S. Cl.

CPC ..... *F21K 9/69* (2016.08); *F21K 9/90* (2013.01); *F21V 5/04* (2013.01); *F21V 17/16* (2013.01); *F21V 27/02* (2013.01); *F21V 29/70* (2015.01); *F21V 31/005* (2013.01); *G09F 13/04* (2013.01); *G09F 13/22* (2013.01); *F21V 17/12* (2013.01); *F21Y 2115/10* (2016.08); *G09F 2013/222* (2013.01)

(58) Field of Classification Search

CPC ... F21K 9/69; F21K 9/90; F21V 29/70; F21V 5/04; F21V 17/16; F21V 31/005; G09F 13/04; G09F 13/22; G09F 2013/222

See application file for complete search history.

(56) References Cited

U.S. PATENT DOCUMENTS

2007/0228983 A1* 10/2007 Nagahara ..... H01J 5/50 313/634
2012/0113633 A1* 5/2012 Bowen ..... F21L 14/023 362/235

(Continued)

*Primary Examiner* — Y M. Lee

(74) *Attorney, Agent, or Firm* — Leanne Taveggia Farrell; Westman, Champlin & Koehler, P.A.

(57) ABSTRACT

A high efficiency LED module includes a circuit board having a plurality of LEDs spaced apart from each other and arranged in a cluster on the circuit board so that a first LED and a second LED are located along a single plane and a third LED is located outside of the single plane. Further included is a lens assembly fixed to the circuit board and having a single, continuous body with a cluster of lenses arranged so as to correspond with the arrangement of LEDs. Each lens includes an upper dome surface having a centrally located dimple, a substantially planar bottom surface in alignment with the other bottom surfaces of the lenses and an indention that is recessed from the bottom surface of the lens so that the indention surrounds one of the LEDs on the circuit board.

18 Claims, 8 Drawing Sheets

(51) Int. Cl.

| | |
|---|---|
| ***F21V 31/00*** | (2006.01) |
| ***G09F 13/04*** | (2006.01) |
| ***G09F 13/22*** | (2006.01) |
| ***F21V 27/02*** | (2006.01) |
| *F21Y 115/10* | (2016.01) |
| *F21V 17/12* | (2006.01) |

(56) References Cited

U.S. PATENT DOCUMENTS

2012/0140437 A1* 6/2012 Kim et al. ..... F21K 9/00 362/249.02
2013/0183779 A1* 7/2013 Pachler ..... F21V 21/002 362/249.02
2014/0009926 A1* 1/2014 Simon ..... F21V 17/12 362/217.13
2014/0126195 A1* 5/2014 Dixon ..... F21S 8/026 362/218
2014/0160742 A1* 6/2014 Rodgers ..... F21V 23/02 362/222
2014/0254134 A1* 9/2014 Pelka ..... F25D 27/00 362/311.02
2016/0053965 A1* 2/2016 Oh et al. ..... G02F 1/133603 362/336
2016/0069557 A1* 3/2016 Ruckgauer ..... F21V 25/12 362/374

* cited by examiner

HIGH-EFFICIENCY LED MODULE

CROSS REFERENCE TO RELATED APPLICATION

The present application is based on and claims the benefit of Chinese patent application number 201520921498.5, filed Nov. 17, 2015, the content of which is hereby incorporated by reference in its entirety.

BACKGROUND

LED backlighting is a technology used to illuminate light boxes, signs or graphic displays, such as graphic displays in retail stores or other locations of high traffic. Backlit graphic displays include substrates of LEDs where each LED may or may not be covered with a lens for spreading or diverging light. The backlit graphic displays further include a back panel, a front panel made of plastic or fabric and in some cases, but not all, a graphic located adjacent the front panel. The substrates of LEDs are mounted to a front surface of the back panel in a grid-like arrangement so that light travels from the LEDs and through the front panel to illuminate the graphic.

The discussion above is merely provided for general background information and is not intended to be used as an aid in determining the scope of the claimed subject matter.

SUMMARY

A high efficiency LED module includes a circuit board having a plurality of LEDs spaced apart from each other and arranged in a cluster on the circuit board so that a first LED and a second LED are located along a single plane and a third LED is located outside of the single plane. Further included is a lens assembly fixed to the circuit board and having a single, continuous body with a cluster of lenses arranged so as to correspond with the arrangement of LEDs. Each lens includes an upper dome surface having a centrally located dimple, a substantially planar bottom surface in alignment with the other bottom surfaces of the lenses and an indention that is recessed from the bottom surface of the lens so that the indention surrounds one of the LEDs on the circuit board.

A high efficiency LED module includes a heat sink, a circuit board mounted to the heat sink, a plurality of LEDs mounted to the circuit board, a lens assembly including an integrally formed body having a plurality of lenses that correspond with each of the plurality of LEDs and an O-ring placed between the lens assembly and the circuit board and surrounding the plurality of LEDs and the corresponding plurality of lenses so as to provide a waterproof seal around the plurality of LEDs. Each lens settles around one of the plurality of LEDs and includes an upper surface and a bottom surface coated with black.

A method of assembling a high efficiency LED module is also provided. The method includes mounting a plurality of LEDs to a circuit board such that they are spaced apart from each other and arranged in a cluster on the circuit board so that a first LED and a second LED are located along a single plane and a third LED is located outside of the single plane. A lens assembly is then fixed over the circuit board. The lens assembly includes a single, continuous body with a cluster of lenses arranged so as to correspond with the arrangement of LEDs. Each lens includes an upper dome surface, a substantially planar bottom surface in alignment with the other bottom surfaces of the lenses and an indention that is recessed from the bottom surface of the lens so that the indention surrounds one of the LEDs on the circuit board.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF ILLUSTRATIVE EMBODIMENTS

Described herein are embodiments of a high-efficient LED module for use in backlit graphic displays, signs or lightboxes. Each module includes three LEDs spaced apart from each other and arranged in a non-linear cluster. A lens assembly including three integrally formed concave lenses covers the three LEDs. Each LED module emits approximately 175 degrees of a diverging light pattern that is evenly spread and contains no chromatic distortion. Only 4-6 modules are needed to illuminate one square meter of a graphic display, sign or lightbox, which means using these high efficient LED modules makes assembling a graphic display, sign or light box easier especially when the sign is not rectangular. in addition, using these high efficient LED modules will also be less expensive and you can vary the number of modules used in order to get a desired brightness.

Figure 1:
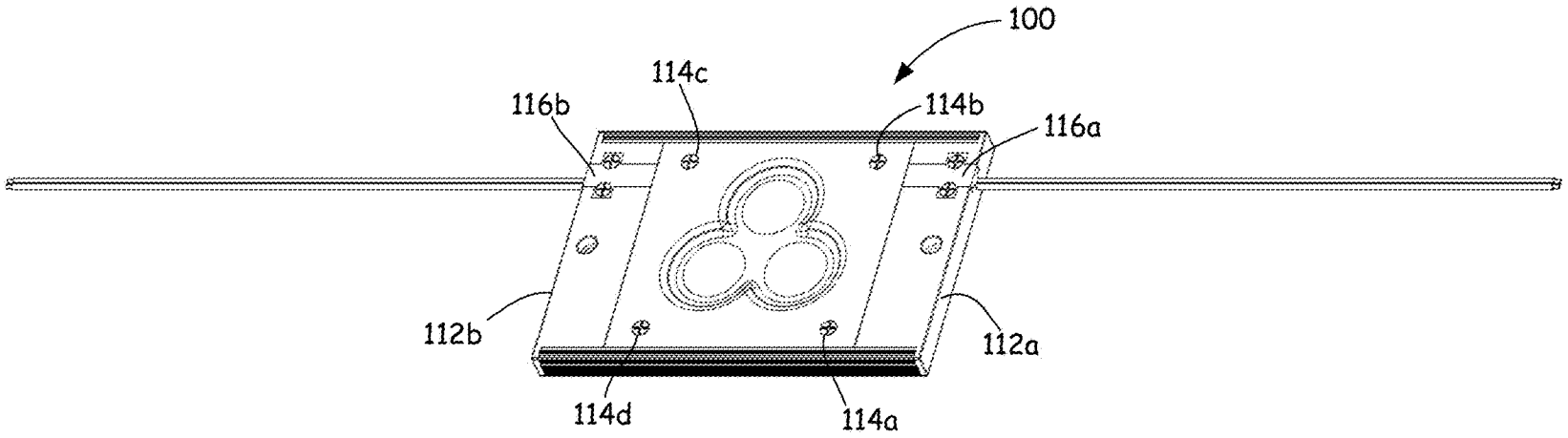
FIG. 1 illustrates a top perspective view of an LED module in accordance with one embodiment.
Figure 2:
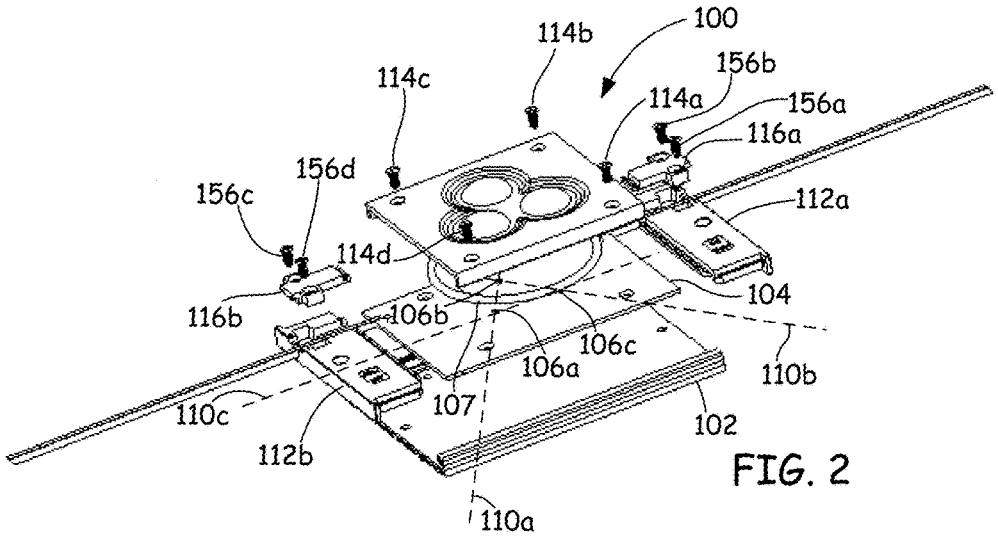
FIG. 2 is an exploded top perspective view of the LED module in FIG. 1.
Figure 3:
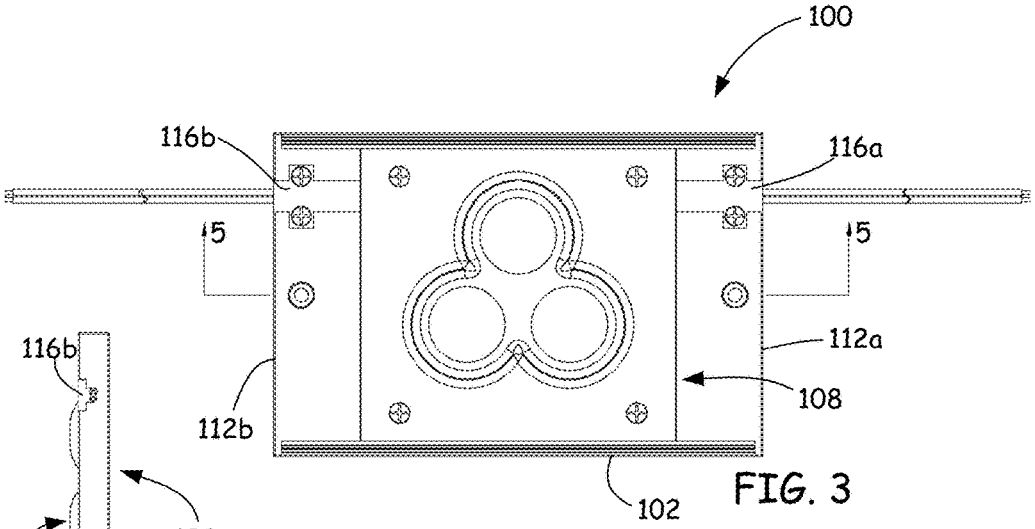
FIG. 3 is a top plan view of the LED module in FIG. 1.
Figure 4:
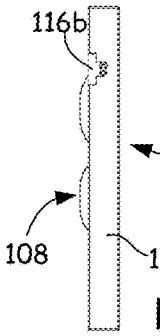
FIG. 4 is a right side view of the LED module in FIG. 1.
Figure 5:
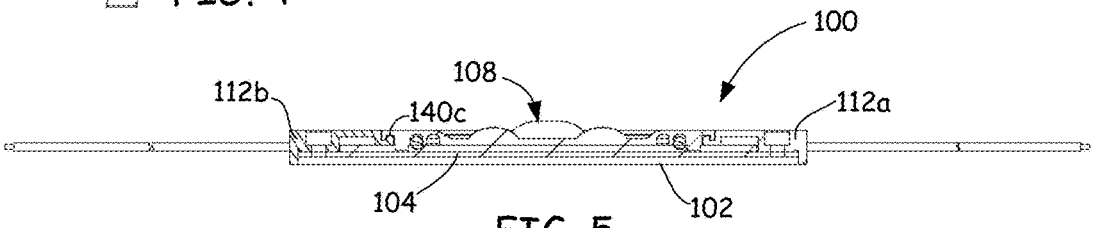
FIG. 5 is a section view of the LED module taken through the section line 5-5 in FIG. 3.

FIG. 1 illustrates a top perspective view of an LED module 100 in accordance with one embodiment. FIG. 2 is exploded top perspective views of LED module 100, FIG. 3 is a top plan view of LED module 100, FIG. 4 is a right side view of LED module 100 and FIG. 5 is a section view of LED module 100 taken through the section line 5-5 in FIG. 3. LED module 100 includes a heat sink 102, a circuit board 104, a plurality of LEDs or three LEDs 106*a*, 106*b* and 106*c*, an O-ring 107 and a lens assembly 108.

As illustrated, LEDs 106*a*, 106*b* and 106*c* are mounted on circuit board 104 and arranged in a non-linear cluster. In particular, each LED 106*a*, 106*b* and 106*c* are spaced apart from each other so that two of the LEDs, such as LED 106*a* and 106*b*, are located along a single plane 110*a* and the third LED, such as LED 106*c*, is located outside of single plane 110*a*. Therefore, LEDs 106*b* and 106*c* are also located along a single plane 110*b* and LED 106*a* is located outside of single plane 110*b* and LEDs 106*c* and 106*a* are also located along a single plane 110*c* and LED 106*b* is located outside of single plane 110*c*. No matter, all three LEDs 106*a*, 106*b* and 106*c* are spaced apart from each other along planes 110*a*, 110*b* and 110*c* by the same distance.

In one embodiment, LEDs 106*a-c* are not traditional LEDs where package size is larger than the actual chip size and the chip is recessed into the frame of the package and wire bonded to pads. In traditional LED packages, the frame limits the beam angle that floods an area with light and when used in combination with a wide angle lens, can present the problem of chromatic distortion. Traditional LED packages provide non-uniform wavelengths of light at different angles of the emitted light pattern. Normally this chromatic distortion is not visible to the human eye, but when traditional LEDs are provided with wide angle lenses, the chromatic distortion is exaggerated and rings of color become visible on the front panel of a graphic display. Rather than using traditional LED packages, embodiments of the disclosure include LEDs 106*a-c* made using Chip Scale Package (CSP) technology or Wafer Level Integrated Chip on PCB (WICOP) technology. CSP eliminates the frame of traditional packages and instead mounts the chip to an intermediate substrate to attach and die bond the chip to the circuit board. Likewise, WICOP also eliminates the traditional frame by directly connecting the chip to the circuit board. Such technologies are available from various suppliers such as Seoul Semiconductor Co., Ltd of South Korea and can produce a beam angle of up to 140 degrees versus the maximum beam angle of 120 degrees of a traditional LED package and provide uniform wavelengths of light.

Circuit board 104 is assembled to heat sink 102 with end components 112*a* and 112*b*. Right side end component 112*a* tightly fixes the right sides of circuit board 104 and heat sink 102 and left side end component 112*b* tightly fixes the lefts sides of circuit board 104 and heat sink 102. In one embodiment, O-ring 107 fits between circuit board 104 and lens assembly 108 and around LEDs 106*a-c* to provide a waterproof seal. In other embodiments, O-ring 107 can be molded with or into lens assembly 108. Lens assembly 108 is fixed to circuit board 104 with screws 114*a*, 114*b*, 114*c* and 114*d*. Wire clips 116*a* and 116*b* hold the wires soldered to circuit board 104 that connect to another LED module 100 or to a power supply. Wire clips 116*a* and 116*b* are located on right and left sides of circuit board 104 and heat sink 102 to secure the wires to right and left end components 112*a* and 112*b* and also provide strain relief to the wires.

Figure 6:
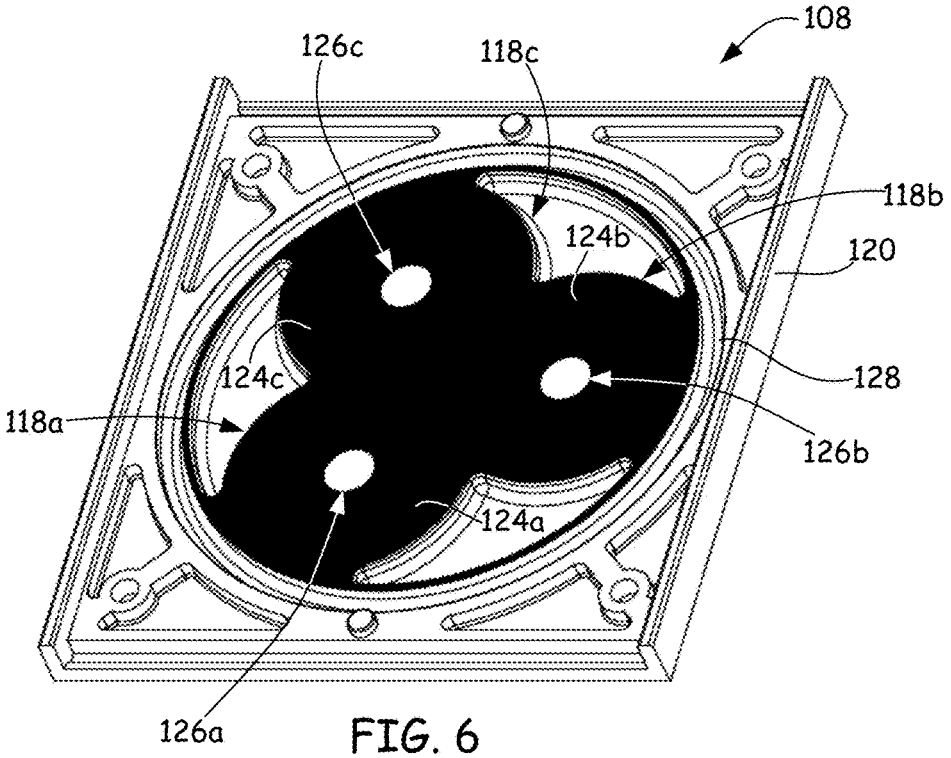
FIG. 6 is a bottom perspective view of a lens assembly of the LED module in FIG. 1.
Figure 7:
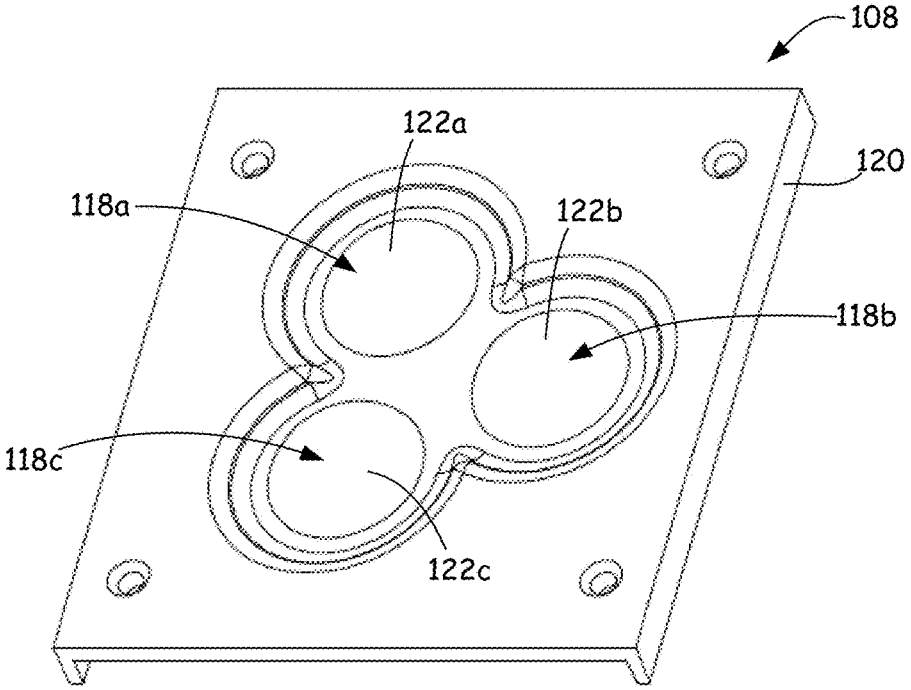
FIG. 7 is a top perspective view of the lens assembly in FIG. 6.
Figure 9:
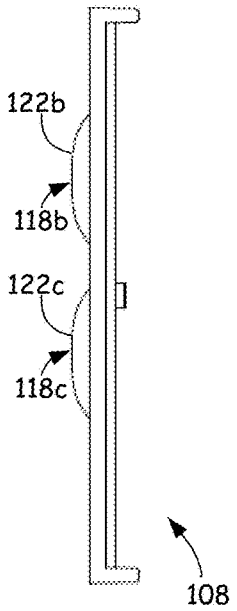
FIG. 9 is a right side view of the lens assembly in FIGS. 6 and 7.
Figure 8:
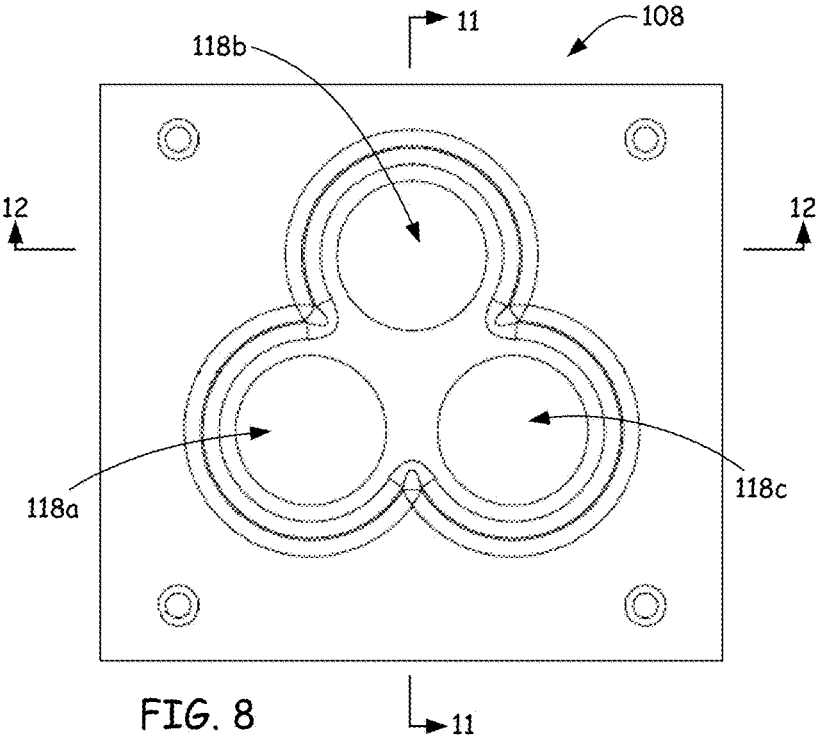
FIG. 8 is a top plan view of the lens assembly in FIGS. 6 and 7.
Figure 10:
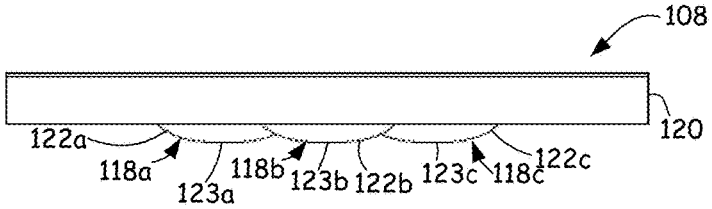
FIG. 10 is a back view of the lens assembly in FIGS. 6 and 7.

FIG. 6 is a bottom perspective view of lens assembly 108, FIG. 7 is a top perspective view of lens assembly 108, FIG. 8 is a top plan view of lens assembly 108. FIG. 9 is a right side view of lens assembly 108 and FIG. 10 is a back view of lens assembly 108. As illustrated, lens assembly 108 includes three substantially identical concave lenses 118*a*, 118*b* and 118*c* made from a single, integrally formed body 120 and arranged in a non-linear cluster similar to the arrangement of LEDs 106*a-c*. For example, body 120 of lens assembly 108 can be made from a transparent optical grade acrylic using various types of manufacturing processes. In particular, body 120 can be formed by injection molding.

Figure 11:
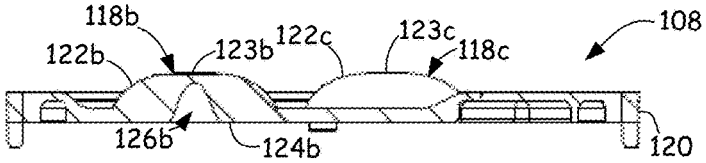
FIG. 11 is a section view of the lens assembly taken through the section line 11-11 in FIG. 8.
Figure 12:
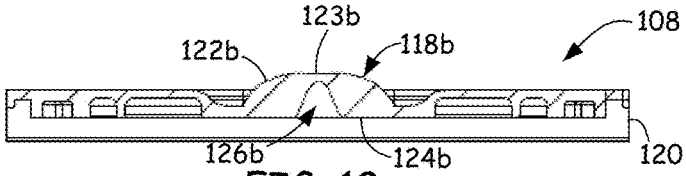
FIG. 12 is a section view of the lens assembly taken through the section line 12-12 in FIG. 8.

FIG. 11 is a section view of lens assembly 108 taken through the section line 11-11 in FIG. 8. FIG. 12 is a section view of lens assembly 108 taken through the section line 12-12 in FIG. 8. In these views, lens 118*b* is shown in section and is representative of sections of lenses 118*a* and 118*c*. The top of each lens 118*a*, 118*b* and 118*c* (best shown in FIGS. 7 and 9-12) includes a domed surface 122*a*, 122*b* and 122*c* having a centrally located dimple 123*a*, 123*b* and 123*c* and the bottom of each lens (best shown in FIG. 6) includes a substantially flat surface 124*a*, 124*b* and 124*c* having an indentation 126*a*, 126*b* and 126*c*. Each indentation 126*a*, 126*b* and 126*c* is defined by a circular opening in the flat bottom surface 124*a-c* of each lens 118*a-c* and a bell shape. The circular openings are best shown in FIG. 6 and the bell shape is best shown in FIGS. 11 and 12. The special shape of each individual lens (also called a batwing lens) provide a wide angle to the beam of light emitted from each LED. In particular, each lens 118*a-c* widens the 140 degree beam angle provided by LEDs 106*a-c* to beam angles that are wider than approximately 170 degrees.

Not only do the batwing lens shape of each lens 118*a*, 118*b* and 118*c* widen the light pattern emitted from each LED 106*a*, 106*b* and 106*c*, but dimples 123*a*, 123*b* and 123*c* in the top surfaces of each lens 118*a*, 118*b* and 118*c* prevent the light pattern being emitted from each LED 106*a*, 106*b* and 106*c* from creating hotspots or uneven bright points of light. Hotspots are created by emitted beams of light that are substantially perpendicular to the front panel (whether it be made of plastic or fabric) of the graphic display. The batwing shape of each lens 118*a*, 118*b* and 118*c* provides an even light pattern for each LED 106*a*, 106*b* and 106*d* by eliminating beams of light that are substantially perpendicular to the front panel of the graphic display.

The use of three wide angle lenses (or batwing lenses) clustered together as shown in the figures can still present the problem of hotspots of light when light being emitted through each lens 118*a*, 118*b* and 118*c* interferes with each other and reflects back into lenses 118*a*, 118*b* and 118*c* and causes light to be emitted substantially perpendicular to the front panel. To remove the hotspots due to reflections created by the clustering of LEDs 106*a*, 106*b* and 106*c* and therefore the clustering of lenses 118*a*, 118*b* and 118*c*, the substantially flat bottom surfaces 124*a-c* of each lens 118*a-c* are coated with black as is illustrated in FIG. 6. In addition, at least the top surface of circuit board 104 is also coated in black to absorb reflected light that exits lenses 118*a*, 118*b* and 118*c*. In one embodiment, substantially flat bottom surface 124*a-c* and circuit board 104 are screen printed with black print. With the black coating, reflected light is absorbed, which removes the hotspot problem and provides an even wash of light for illuminating a graphic on a light box.

Still further, lens assembly 108 includes an integrally formed groove 128 in the bottom of body 120. Groove 128 circles around lenses 118*a-c* and receives at least a portion of O-ring 107. In some embodiment, the top surface of circuit board 104 also includes a groove. After O-ring 127 is settled in groove 128 in lens assembly 108, a portion of O-ring 107 mates with the groove on circuit board 104 so that O-ring 107 is held tightly between circuit board 104 and lens assembly 108 to provide the waterproof seal and to prevent sliding between circuit board 104 and lens assembly 108. In other embodiments and as shown in FIG. 2, circuit board 104 does not include a groove. In this case, O-ring 107 is settled in groove 128 of lens assembly 108 and is held tightly to the top surface of circuit board 104 to provide the waterproof seal.

Figure 13:
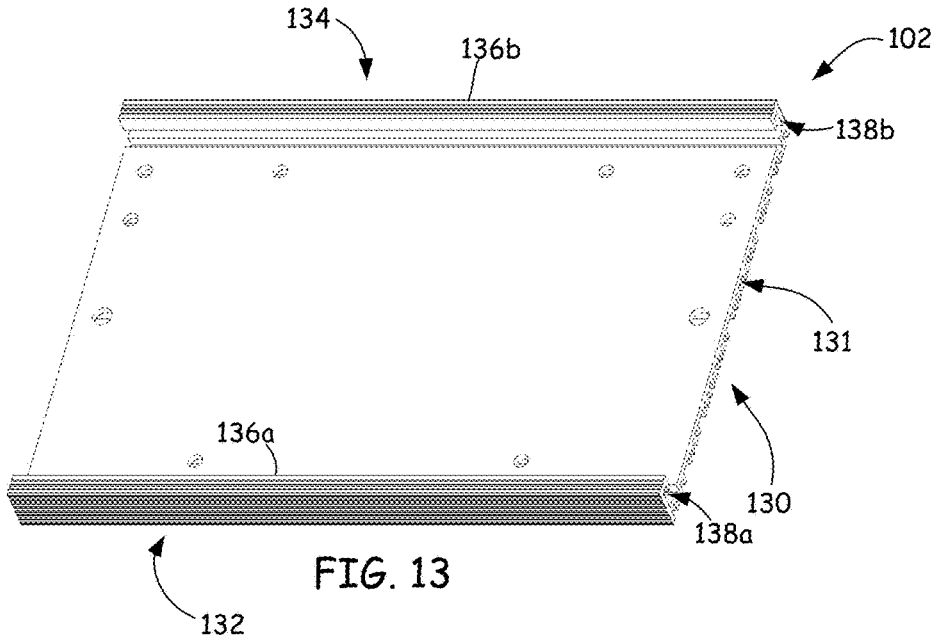
FIG. 13 is a bottom perspective view of a heat sink of the LED module in FIG. 1.
Figure 15:
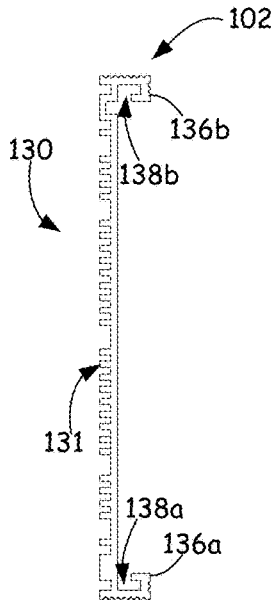
FIG. 15 is a left side view of the heat sink in FIG. 13.
Figure 14:
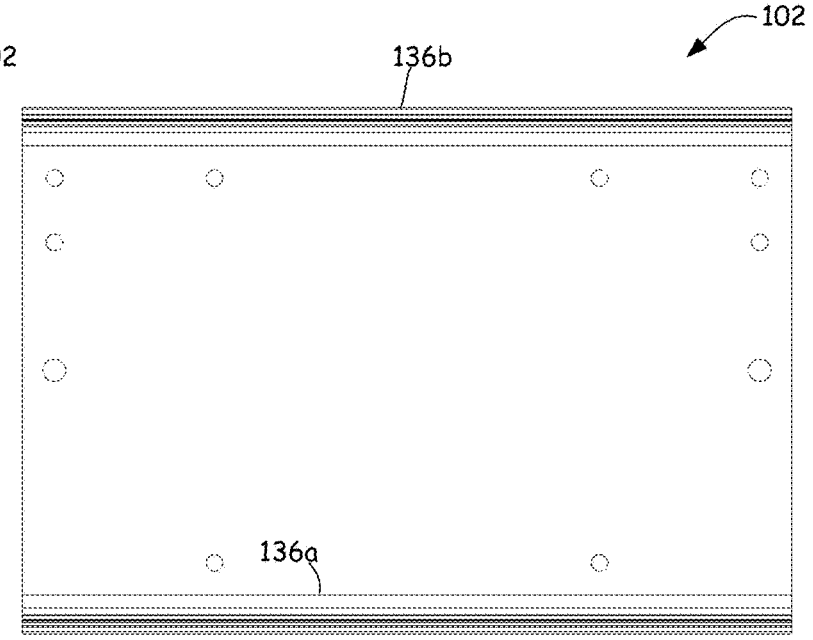
FIG. 14 is a top plan view of the heat sink in FIG. 13.

FIG. 13 is a bottom perspective view of heat sink 102, FIG. 14 is a top plan view of heat sink 102 and FIG. 15 is a left side view of heat sink 102. As illustrated, the bottom side 130 of heat sink 102 includes a plurality of protrusions or fins 131. The front side 132 and the back side 134 each include a protrusion 136*a* and 136*b* having a track 138*a* and 138*b*, respectively. When assembling circuit board 104 to heat sink 102, the front and back edges of circuit board 102 are slid along tracks 138*a* and 138*b*, respectively. The width of circuit board 104 is less than the width of heat sink 102. Therefore after assembled, portions of either ends of tracks 138*a* and 138*b* will be free of circuit board 104.

Figure 16:
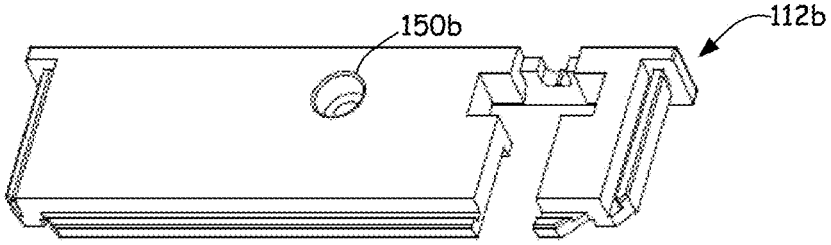
FIG. 16 is a top perspective view of one of the end components of the LED module in FIG. 1.
Figure 17:
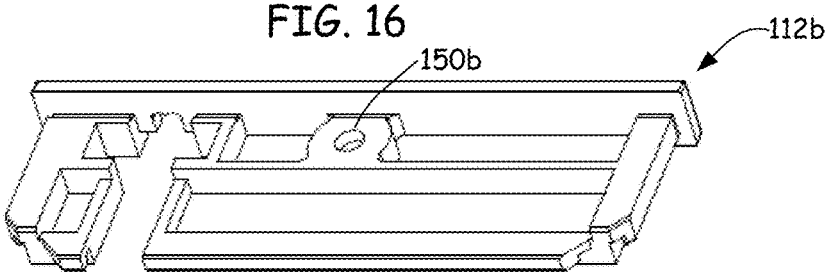
FIG. 17 is a bottom perspective view of the end component in FIG. 16.
Figure 18:
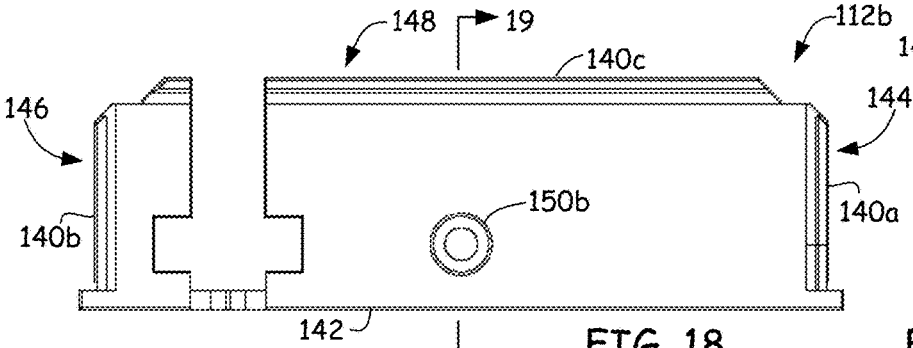
FIG. 18 is a top plan view of the end component in FIG. 13.
Figure 19:
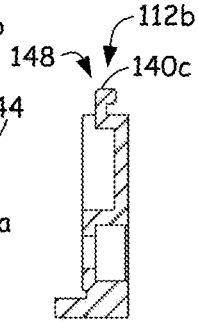
FIG. 19 is a section view of the end component taken through the section line 19-19 in FIG. 18.
Figure 20:
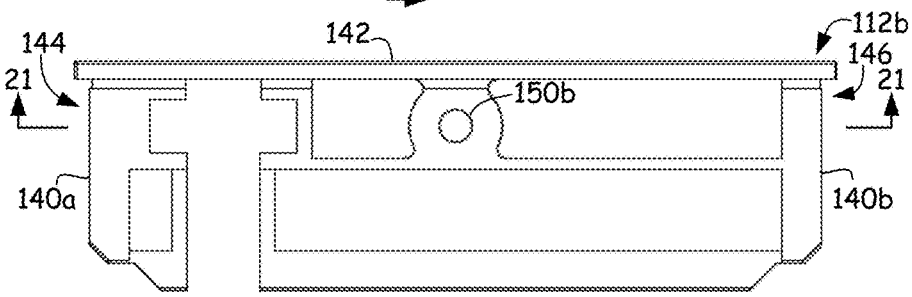
FIG. 20 is a bottom plan view of the end component in FIG. 13.
Figure 21:
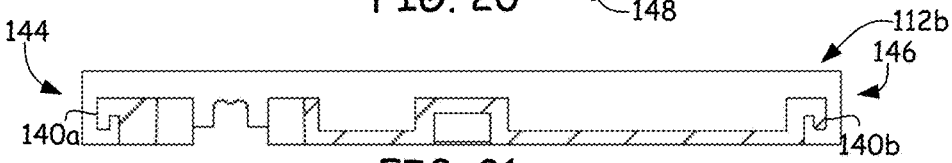
FIG. 21 is a section view of the end component taken through the section line 21-21 in FIG. 20.

FIG. 16 is a top perspective view of end component 112*b* with FIG. 17 being a bottom perspective view, FIG. 18 being a top plan view, FIG. 19 being a section view taken through the section line 19-19 in FIG. 18, FIG. 20 being a bottom plan view and FIG. 21 being a section view taken through the section line 21-21 in FIG. 20. End component 112*a* (FIG. 2) is a substantially a mirror of end component 112*b*, therefore, end component 112*b* is representative of the structure of end components 112*a* and 112*b*. As illustrated, end component 112*b* includes a first rail 140*a* having a groove that runs substantially perpendicular to a side 142 of end component 112*b* and is on a front 144 of end component 112*b*. Opposite first rail 140*a* is a second rail 140*b* that runs substantially perpendicular to side 142 of end component 112*b* and is on a back 146 of end component 112*b*. First rail 140*a* of end component 112*b* mates with track 138*a* of heat sink 102 and second rail 140*b* of end component 112*b* mates with track 138*b* of heat sink 102. Likewise, similar elements of end component 112*a* mate with track 138*a* at the front 132 and track 138*b* at the back 134 of heat sink 102 to secure circuit board 104 to heat sink 102.

End component 112*b* includes yet another rail 140*c* having a groove that runs substantially parallel to side 142, but is located on an opposing side 148 from side 142. Rail 140*c* mates with left protruding side of body 120 of lens assembly. This connection can be seen clearly in the FIG. 5 section view where rail 140*c* is labeled. Together rails 140*a*, 140*b* and 140*c* secure circuit board 104 to heat sink 102 and secure lens assembly 108 to circuit board 104 and heat sink 102. Still further, there is an install hole 150*b* through end components 112*b* (and therefore also through end component 112*a*) where screws can further secure end component 112*b* (and therefore also end component 112*b*) to heat sink 102.

Figure 22:
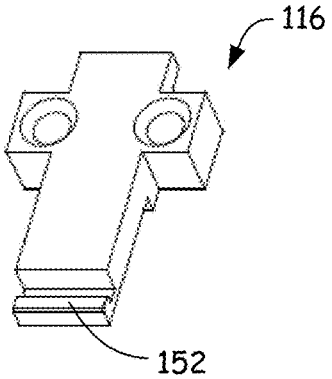
FIG. 22 is a top perspective view of one of the wire clips of the LED module in FIG. 1.
Figure 23:
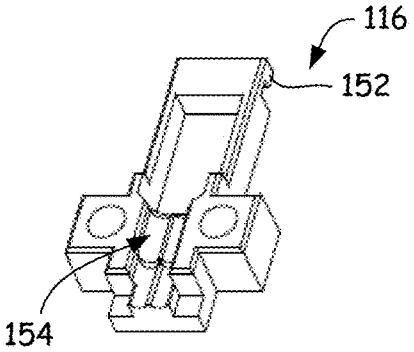
FIG. 23 is a bottom perspective view of the wire clip in FIG. 22.
Figure 24:
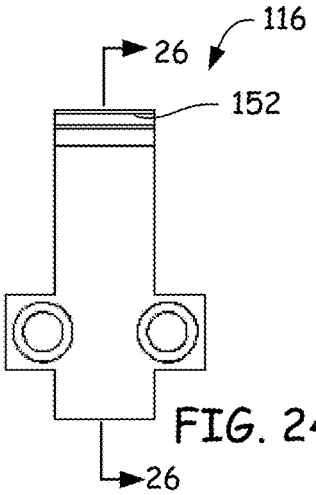
FIG. 24 is a top plan view of the wire clip in FIG. 22.
Figure 25:
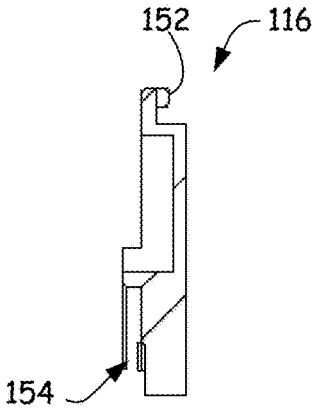
FIG. 25 is a section view of the wire clip taken through the section line 25-25 in FIG. 24.
Figure 26:
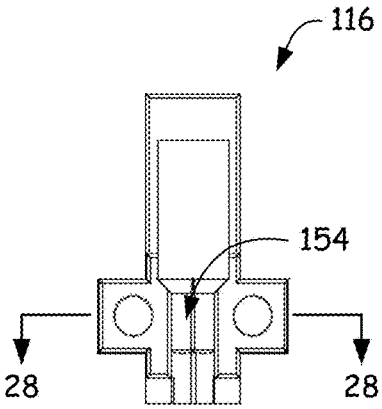
FIG. 26 is a bottom plan view of the wire clip in FIG. 22.
Figure 27:
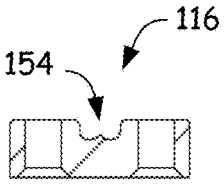
FIG. 27 is section view of the wire clip taken through the section line 27-27 in FIG. 26.

FIG. 22 is a top perspective view of wire clip 116 with FIG. 23 being a bottom perspective view. FIG. 24 being a top plan view, FIG. 25 being a section view taken through the section line 25-25 in FIG. 24, FIG. 26 being a bottom plan view and FIG. 27 being a section view taken through the section line 27-27 in FIG. 26. Wire clip 116*b* (FIG. 2) is substantially identical to wire clip 116*a* (FIG. 2), therefore, the wire clip 116 in FIGS. 22-27 is representative of the structure of both substantially identical wire clips 116*a* and 116*b*. As illustrated, wire clip 116 includes two key components: a rail 152 and a concave receiver 154. Rail 152 has a groove that mates with one of right or left protruding sides of body 120 of lens assembly 108 depending on which side wire clip 116 is attached to lens assembly 108. Concave receiver 154 is configured to hold the wires (shown in FIGS. 1-5) that connect to the circuit board 104 for connecting to a power supply or for connecting to other LED modules 100. Upon wire clip 116 being secured to one of the end components 112*a* and 112*b* and heat sink 102 using screws 156*a-d* (FIG. 2), concave receiver 154 provides strain relief to the wires it holds in place.

Figure 28:
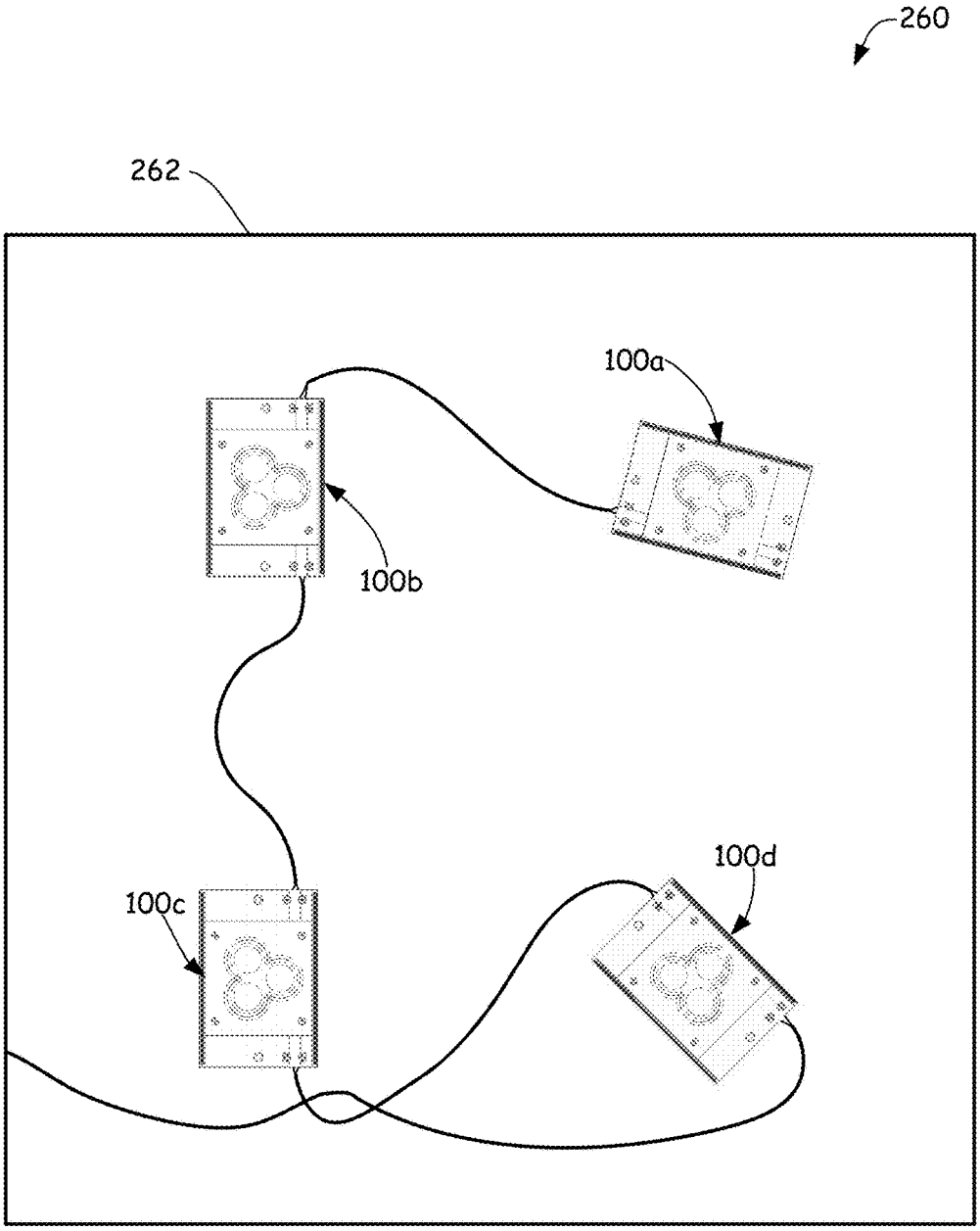
FIG. 28 is a front view of a plurality of LED modules mounted to a back panel of a backlit graphic display or light box.

FIG. 28 is a front view of a plurality of high efficiency LED modules 100*a-d* mounted to a back panel 262 of a backlit graphic display, sign or light box 260. In one embodiment, each high efficiency LED module 100*a-d* is mounted to back panel 262 using an adhesive tape or other similar product. As illustrated, in FIG. 28, only four high efficiency LED modules 100*a-d* are needed to evenly light a graphic on graphic display, sign or light box 260. In particular, only 4-6 high efficiency LED modules 100 are needed to evening light a graphic display, sign or light box.

Although elements have been shown or described as separate embodiments above, portions of each embodiment may be combined with all or part of other embodiments described above.

Although the present invention has been described with reference to preferred embodiments, workers skilled in the art will recognize that changes may be made in form and detail without departing from the spirit and scope of the invention.

What is claimed is:

1. A high efficiency LED module comprising:

a circuit board including a plurality of LEDs spaced apart from each other and arranged in a cluster on the circuit board so that a first LED and a second LED are located along a single plane and a third LED is located outside of the single plane; and a lens assembly fixed to the circuit board and including a cluster of integral lenses made of a single, continuous body and arranged so as to correspond with the arrangement of LEDs, wherein the single, continuous body of integral lenses extends across an area that encompasses at least a distance between each of the plurality of corresponding LEDs and comprises:

a continuous bottom surface having a plurality of indentions and a substantially planar portion, wherein each of the plurality of indentions intersects with the substantially planar portion at a circular opening, is recessed from the substantially planar portion of the continuous bottom surface and surrounds one of the plurality of LEDs on the circuit board;

a continuous upper surface including a plurality of domes and a substantially planar portion, wherein each of the plurality of domes protrude from the substantially planar portion of the continuous upper surface, surround one of the plurality of LEDs and one of the plurality of indentions of the continuous bottom surface and have a centrally located dimple; and wherein each of the plurality of domes of the single, continuous body of integral lenses are entirely separated from each other by portions of the substantially planar portion of the continuous upper surface; and wherein an entirety of the substantially planar portion of the continuous bottom surface of the single, continuous body of integral lenses is coated in black so that internal light refraction that bleeds between the integral lenses is absorbed.

2. The high efficiency LED module of claim 1, further comprising an O-ring being received at least partially by a groove in a bottom of the single, continuous body of the lens assembly that circles around plurality of domes and the plurality of indentions and is fixed between a top of the circuit board and the bottom of the single, continuous body of the lens assembly to provide a waterproof seal around the plurality of LEDs.

3. The high efficiency LED module of claim 1, further comprising a heat sink to which the circuit board is mounted.

4. The high efficiency LED module of claim 3, wherein the circuit board slidably mounts to the heat sink by mating edges of the circuit board with protruding tracks of the heat sink.

5. The high efficiency LED module of claim 3, further comprising a pair of end components that secure each of the right and left sides of the lens assembly to the circuit board and the heat sink.

6. The high efficiency LED module of claim 5, wherein the end components include three rails having grooves to mate with edges of the lens assembly and the heat sink.

7. The high efficiency LED module of claim 5, further comprising a pair of wire clips mounted to the right and left sides of the lens assembly and each wire clip including a concave receiver for surrounding wires that are connected to the circuit board to provide strain relief.

8. The high efficiency LED module of claim 1, wherein the indention in each lens of the lens assembly comprises a bell shape.

9. A high efficiency LED module comprising:

a heat sink;

a circuit board mounted to the heat sink;

a plurality of LEDs mounted to the circuit board;

a lens assembly having an integrally formed body and comprising:

a continuous bottom surface having a substantially planar portion and a plurality of recesses recessed from the substantially planar portion, wherein each of the plurality of recesses corresponds with and is located around one of the plurality of LEDs;

a continuous top surface having a substantially planar portion and a plurality of domes, wherein each of the plurality of domes corresponds with and is located around one of the plurality of recesses and one of the plurality of LEDs;

wherein each of the plurality of domes of the continuous top surface are entirely separated from each other by portions of the substantially planar portion of the continuous top surface;

a pair of clips that are each fixed to an end of the lens assembly and have concave receivers for receiving wires connected to the circuit board so as to provide strain relief;

a right side end component that secures a right side of the circuit board with the heat sink; and a left side component that secures a left side of the circuit board with the heat sink, wherein one of the pair of clips is further mated to the heat sink and fastened to the right side end component and wherein the other of the pair of clips is further mated to the heat sink and fastened to the left side end component.

10. The high efficiency LED module of claim 9, further comprising an O ring placed between the lens assembly and the circuit board and surrounding the plurality of LEDs and the corresponding plurality of recesses and the plurality of domes so as to provide a waterproof seal around the plurality of LEDs, wherein on a bottom of the integrally formed body comprises a groove for at least partially receiving the O-ring.

11. The high efficiency LED module of claim 9, wherein the plurality of LEDs are spaced apart from each other and arranged in a cluster on the circuit board so that a first LED and a second LED are located along a single plane and a third LED is located outside of the single plane.

12. The high efficiency LED module of claim 11, wherein the plurality of recesses and the plurality of domes are arranged so as to correspond with the arrangement of LEDs.

13. The high efficiency LED module of claim 12, wherein the substantially planar portion of the continuous bottom surface of the integrally formed body of the lens assembly is coated in black.

14. The high efficiency LED module of claim 13, wherein each recess of the continuous bottom surface comprises a bell shape.

15. The high efficiency LED module of claim 9, wherein the circuit board slidably mounts to the heat sink by mating edges of the circuit board with protruding tracks of the heat sink.

16. A method of assembling a high efficiency LED module, the method comprising:

mounting a plurality of LEDs to a circuit board such that they are spaced apart from each other and arranged in a cluster on the circuit board so that a first LED and a second LED are located along a single plane and a third LED is located outside of the single plane;

fixing a lens assembly over the circuit board, wherein the lens assembly comprises an integral body including a continuous top surface and a continuous bottom surface that together form a cluster of lenses arranged so as to correspond with the arrangement of LEDs, wherein each lens includes a dome that is a portion of the continuous top surface and is separated from other domes by a substantially planar portion of the continuous top surface and a recessed indention that is a portion of the continuous bottom surface and is separated from other recessed indentions by a substantially planar portion of the continuous bottom surface, wherein the substantially planar portion of the continuous bottom surface of the lens assembly is coated in black so that internal light refraction is absorbed; and securing the lens assembly to right and left sides of the circuit board with a pair of end components, wherein the end components include rails having grooves to mate with edges of at least the lens assembly.

17. The method of claim 16, further comprising at least partially placing an O-ring in a groove in a bottom of the integral body of the lens assembly that circles around the cluster of lenses before fixing the lens assembly to the circuit board so as to provide a waterproof seal around the plurality of LEDs.

18. A high efficiency LED module comprising:

a heat sink;

a circuit board mounted to the heat sink and including a plurality of LEDs spaced apart from each other and arranged in a cluster on the circuit board so that a first LED and a second LED are located along a single plane and a third LED is located outside of the single plane;

a lens assembly fixed to the circuit board and including a single, continuous body including a continuous top surface and a continuous bottom surface that together provide a cluster of lenses arranged so as to correspond with the arrangement of LEDs, wherein each lens includes an upper dome that is a portion of the continuous top surface that is separated from other domes by a substantially planar portion of the continuous top surface and a recessed indention that is a portion of the continuous bottom surface and is separated from other recessed indentions by a substantially planar portion of the continuous bottom surface;

a pair of end components that secure each of the right and left sides of the lens assembly to the circuit board and the heat sink, wherein the end components include rails having grooves to mate with edges of the lens assembly and the heat sink; and a pair of clips that are each fixed to an end of the lens assembly and have concave receivers for receiving wires connected to the circuit board so as to provide strain relief, wherein one of the pair of clips is further mated to the heat sink and fastened to one of the pair of end components and wherein the other of the pair of clips is further mated to the heat sink and fastened to the other of the pair of end components.

* * * * *